US005337942A

United States Patent [19]

McClelland

[11] Patent Number: 5,337,942

[45] Date of Patent: Aug. 16, 1994

[54] FILM-PROCESSING ENVELOPE

[75] Inventor: E. Leslie McClelland, Lancaster, Ohio

[73] Assignee: Cyril-Scott Company, Lancaster, Ohio

[21] Appl. No.: 80,124

[22] Filed: Jun. 23, 1993

[51] Int. Cl.[5] ..... B65D 27/08

[52] U.S. Cl. ..... 229/72; 229/70; 229/80

[58] Field of Search ..... 229/70, 72, 80, 80.5

[56] References Cited

U.S. PATENT DOCUMENTS

| | | | |
|---|---|---|---|
| 791,362 | 5/1905 | Parmenter . | |
| 1,234,879 | 7/1917 | Crocker | 229/72 |
| 1,420,470 | 6/1922 | Burgess | 229/72 |
| 1,677,022 | 7/1928 | Deutschmeister . | |
| 2,279,327 | 4/1942 | Kehr . | |
| 3,356,286 | 12/1967 | Greason . | |
| 3,381,888 | 5/1968 | Schleutermann et al. | 229/72 |
| 3,537,638 | 11/1970 | Hyman . | |
| 3,788,540 | 1/1974 | Sammons | 229/72 |
| 3,817,445 | 6/1974 | Greason . | |
| 3,968,927 | 7/1976 | Katz et al. . | |
| 3,971,507 | 7/1976 | Stevenson | 229/80 X |
| 4,047,661 | 9/1977 | Klein . | |
| 4,192,448 | 3/1980 | Porth | 229/80 |
| 4,785,940 | 11/1988 | Wilson . | |
| 5,060,847 | 10/1991 | Angus . | |
| 5,102,035 | 4/1992 | Cecchi . | |

*Primary Examiner*—Allan N. Shoap
*Assistant Examiner*—Jes F. Pascua
*Attorney, Agent, or Firm*—Cushman Darby & Cushman

[57] ABSTRACT

A three-panel, one-gusset film processing envelope is manufactured in line from continuous web stock. The front and rear main panels are created from what was the central and one lateral marginal portion of the web, and the pocket-dividing interior panel from what was the other lateral marginal portion of the web. A tear-off claim check initially faces a double thickness nonfolded fold-over flap for closing the pockets. A transverse band of resealable adhesive is exposed through a die-cut window in the flap. Entrance to the adjunct pocket for receiving negatives on the trip back from the processor is passively facilitated by the consumer in the act of folding over the flap for the trip to the processor. The envelope bottom is closed by a transverse glue strip which, by involving all three panels, provides a relatively stiff bottom marginal portion which preferably bears the machine readable unique number for the transaction, thereby facilitating presentation of the envelope for reading by a reading device.

14 Claims, 4 Drawing Sheets

FILM-PROCESSING ENVELOPE

BACKGROUND OF THE INVENTION

In the photographic film processing industry, a very successfully implemented practice exists in which a customer, who wishes to have film processed and turned into prints, picks up a special envelope packet, either from the display rack or counter at the retail location, such as a grocery store, drug store or film processor's kiosk, or from among the coupons and advertisements received in a direct mailing or as a newspaper insert.

The typical film-processing envelope packet now in use has a portrait orientation (is taller than wide, and printed with text lines extending widthwise of the envelope). On a typical packet, expansion gables extend along both long sides, one short side is closed (typically by a doubling over of the web stock of which the packet is made) and the other short side (i.e., the top end) is tentatively closed by a folded-over integral flap, a lower-end extension of which is separable along a transverse line of weakness to provide a claim check (receipt).

Typically, the underside of the flap and the rear main panel of the envelope body at a confrontingly corresponding location are provided with transversally extending bands (patches) of adhesive. The adhesive typically used is a latex-based resealable adhesive which needs no moistening. However, it is one which has a relatively short tack life, so that, with a month or so, depending on temperature and humidity, its ability to stick to itself is largely gone. It no longer behaves like rubber cement, but more like a nonskid floor surface coating.

Typically, the front and rear main panels of the envelope, and both surfaces of the closure flap and claim check are printed with text and graphics, most often in at least two colors, and frequently in three or four colors or full color. Much of the text and graphics instructs the customer how to use the product, what their expectations should be and provides spaces for the customer to communicate needed information to the store and/or to the processor, and vice versa. Typical information requested from the customer via blanks on the envelope are customer name and contact information, date of drop off; brand, type and number of exposures of film, or negative number and quantity (or size and quantity) of reprints or enlargements of negatives desired, how many prints of each negative are desired, size, special instructions, acceptance of special deal terms, and the like. Typically, both the envelope (e.g., on the flap) and the claim check include a statement of limitation of liability of the store and processor. Also typically, a unique number for each packet is imprinted at least once on the envelope, and on the claim check. For instance, it may be printed on the outside surface of the claim check, on the front main panel of the envelope and as a machine-readable (e.g., U.P.C.) bar code at the base of the front main panel of the envelope (at a location where the envelope is two layers thick, these layers being the front and rear main panels of the envelope body).

Although most of the printing on the conventional film-processing envelope packet occurs on what was the same one surface of the continuous web stock from which the packet was made, some printing (e.g., the repeated statement of limitation of liability) may occur, typically in one color, on the rear surfaces of the flap and claim check (and, therefore, on what was the opposite surface of the web stock).

Typically, some die cutting is involved in manufacture of the conventional film-processing envelope, not only to sever the blank for one envelope from the continuous web, and to provide the perforated line of weakness along which the claim check is to be severed by the customer from the flap, but also to reduce the amount of sheet material disposed at the "inside of the elbow" in the gables where the web stock is doubled over at the lower end of the envelope. However, typically, the flap and claim check are as wide as each main panel of the envelope (some web stock material which corresponds to the gable widths being cut away from the region of the web stock which produces the combined flap and claim check). Some of each gable is integral with the front main panel, and the remainder with the rear main panel, these portions of each gable being permanently glued together during packet manufacture. In the manufacturing process, the lengthwise direction of the continuous web corresponds to the widthwise direction of the individual packets that are being produced. Machinery for producing such packets is commercially available. Although the packets are more commonly made from paper, they can be made from paper substitutes such as Tyvek bonded nonwoven polyolefin web stock.

The customer, who has picked up a packet, completes the blanks, places their undeveloped film, or their negatives to be printed in the single pocket, seals the envelope, tears off the claim check and deposits the filled envelope in the slot of a pick-up station or with the clerk at a service center in the store or at the kiosk, retaining the uniquely numbered claim check.

On its way to, at and from the film processing location, the customer's order is kept track of using the unique number as bar coded near the lower margin on the front panel of the envelope.

At the film processing location, the physical elements which are going back to the customer, typically the negatives and the prints conventionally are placed in respective pockets of a two-pocketed return envelope. This envelope typically is manufactured from two continuous webs, one of which is wider than the other. The wider one is provided with a succession of transverse glue strips near one longitudinal edge and doubled over on itself with the narrower web captured between its layers and thereby becoming united to the wider web by the glue strips. The wider web is also folded along a longitudinal line to provide a flap which, when folded down, covers the mouths of the two resulting pockets on each return envelope, the individual return envelopes being created by severing the web transversally intermediate each glue strip, so that a respective half of each glue strip is located at each end of each envelope.

The return envelope, with its contents in its pockets, is placed bodily in the same uniquely numbered envelope that the customer had used for sending in the photographic materials for processing, resealed using the latex-based resealable adhesive on the flap and rear main panel, and returned to the location at which the customer is intended to pick up and pay for the film processing work.

It is a measure of the success of the foregoing procedure, that the volume of envelopes used has become so great, that it has become a matter of concern that avoidable waste is involved by the use of two envelopes for each transactional cycle.

The present inventor has rethought the foregoing procedure, in order to devise a modification which is acceptable at each stage, but eliminates one of the envelopes by redesigning the other (and its manufacturing process).

SUMMARY OF THE INVENTION

A three-panel, one-gusset film processing envelope is manufactured in line from continuous web stock. The front and rear main panels are created from what was the central and one lateral marginal portion of the web, and the pocket-dividing interior panel from what was the other lateral marginal portion of the web. A tear-off claim check initially faces a double thickness nonfolded fold-over flap for closing the pockets. A transverse band of resealable adhesive is exposed through a die-cut window in the flap. Entrance to the adjunct pocket for receiving negatives on the trip back from the processor is passively facilitated by the consumer in the act of folding over the flap for the trip to the processor. The envelope bottom is closed by a transverse glue strip which, by involving all three panels, provides a relatively stiff bottom marginal portion which preferably bears the machine readable unique number for the transaction, thereby facilitating presentation of the envelope for reading by a reading device.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
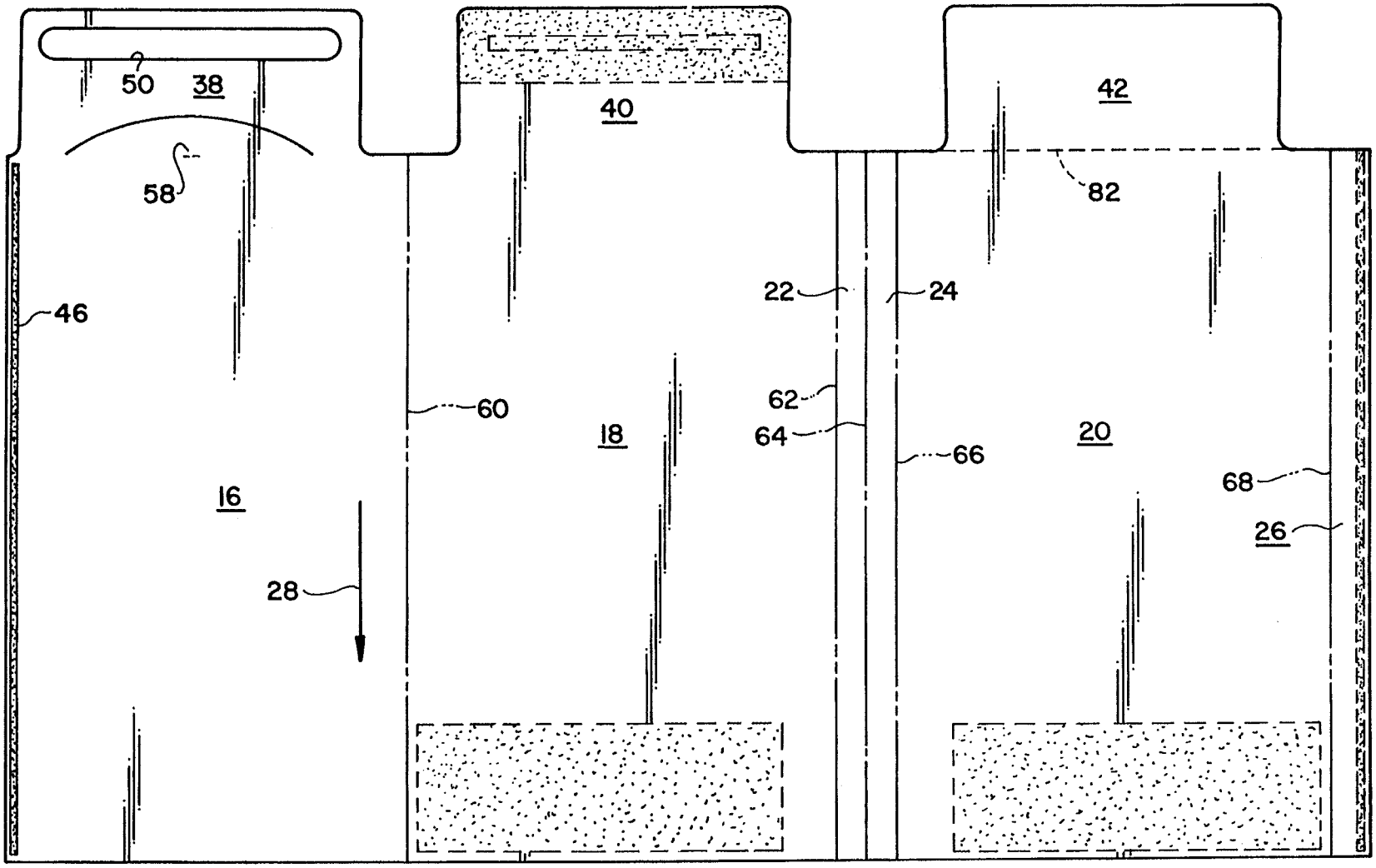
FIG. 1 is an elevational view of the face of the blank that will become the inside of a preferred embodiment of the film-processing envelope constructed in accordance with principles of the present invention.
Figure 3:
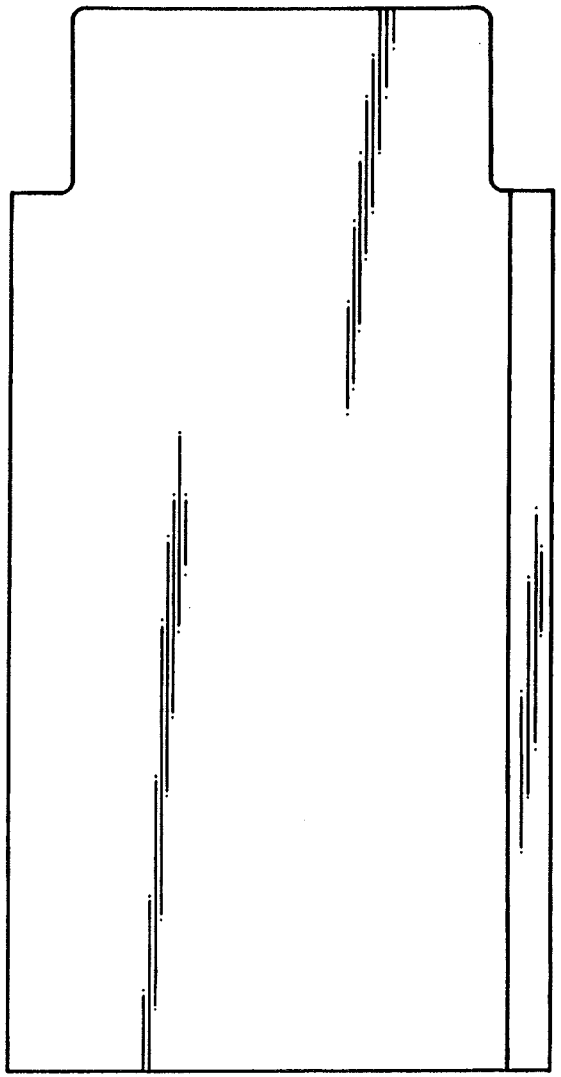
FIG. 3 is an elevational view of the rear of the envelope.
Figure 2:
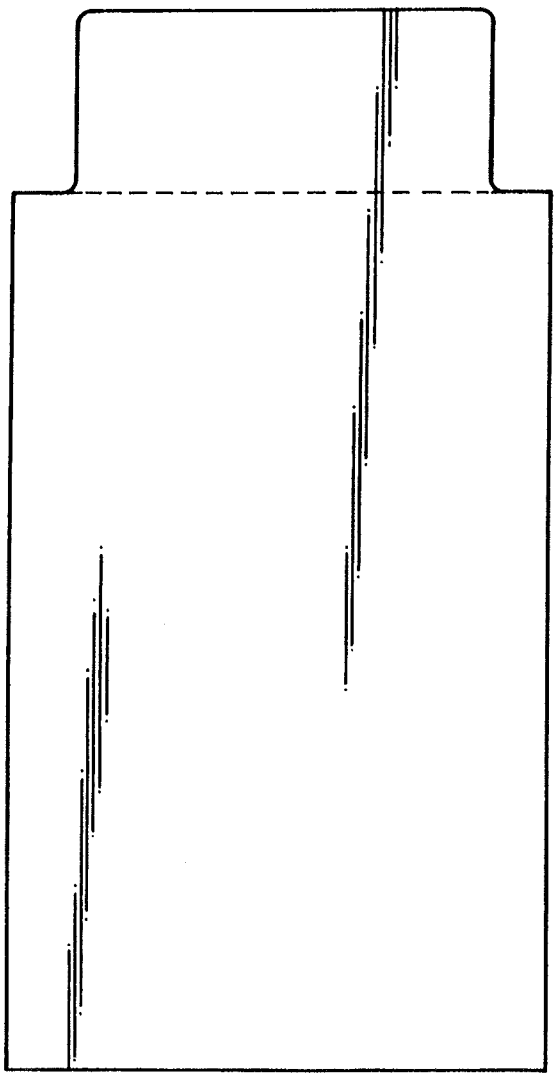
FIG. 2 is an elevational view of the front of the envelope.
Figure 4:
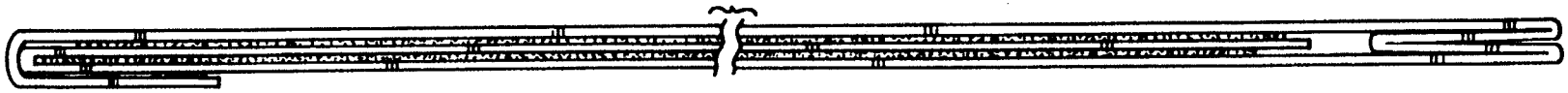
FIG. 4 is a bottom end view of the envelope.
Figure 5:
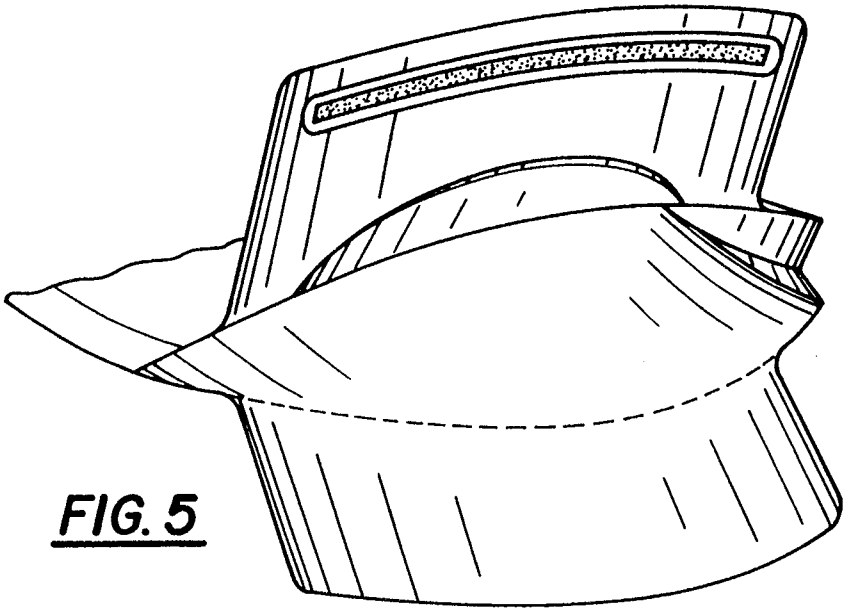
FIG. 5 is a top end view of the envelope, as opened by the consumer for inserting photographic material for the trip to the processor.
Figure 6:
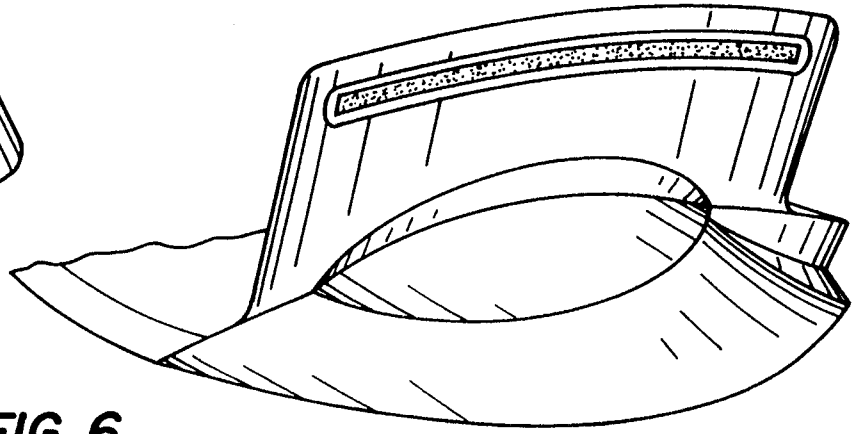
FIG. 6 is a top end view of the envelope, as opened by the processor for inserting photographic material for the trip to the consumer's drop-off/pick-up location.

One side of a blank 10 for making the envelope 12 of the present invention is shown in FIG. 1. In practice, the envelope is preferably made in succession with a plurality of like such envelopes from a web of flexible sheet material, e.g., paper, as will be further explained below with reference to FIG. 7. There is nothing exotic about either the materials or the apparatus used for making the envelope, i.e., in other processes to produce other designs of envelopes, all of the paper stock, glue, adhesive, web stock handling equipment (folders, perforators, knives, glue applicators, die cutters and the like) may be such as are in common use for fabricating business envelopes and forms. By preference, the envelope is manufactured with the longitudinal (top-to-bottom) direction of the envelope aligned with the longitudinal direction of the web stock from which its blank is made.

Although the novelty of the invention is not predicated at all on the size of the envelope, it is perhaps of interest to persons in the art, that the preferred overall width of the blank is 17.25 inches, and of the envelope is 5.50 inches, and that the overall length of the blank (and envelope, with its flap not folded over) is 10,875 inches. The elevational views are drawn approximately to scale, so other preferred dimensions can be sealed from those views.

The blank 10 has two opposite faces; the one shown in FIG. 1 will, for convenience, be called the inside face 14, because most of it eventually forms pocket-lining surfaces of the envelope 12.

The blank 10 is shown to include a pocket-dividing panel 16, a front main panel 18, a rear main panel 20, a pair of adjoining narrow gable panels 22, 24 and a narrow lap joint panel 26. In the preferred arrangement, these panels serially adjoin one another.

The preferred direction of travel of the continuous web from which the blank 10 is formed, is indicated by the arrow 28.

One transverse end 30 of the blank 10 (the one corresponding to the bottom of the envelope 12) is shown being cut straight across the web from end to end, at 90 degrees to the opposite longitudinal edges 32, 34.

At the opposite end 36 of the blank, a comb-shaped portion or succession of block portions are die-cut away in the manufacturing process, so as to create as central, longitudinal extensions of the panels 16, 18 and 22, correspondingly shaped, sized and positioned integral cantilevered extension tabs 38, 40 and 42. These respectively form the rear (underside) layer of the fold-over flap 44 of the envelope 12, the front (outer side) layer of that flap 44, and the tear-off claim check (receipt) 82.

The die cutting of the end 36 can be done either at a stage while the web is flat and not yet folded (i.e., is in its FIG. 1 disposition), or after it has been glued and folded into a longitudinally continuous succession of not yet severed envelopes. The latter procedure is preferred, because it permits faster manufacturing-line speed and ensures front-to-back registration of the perimeters of the tabs 38, 40 and 42.

The following features on the blank 10 also bear noticing:

The surface 14 is provided with a longitudinal glue line 46 which begins near the end 30 and extends up to adjacent the base of the tab 38, marginally of the longitudinal edge 32, on the pocket-dividing panel 16. In practice, the blank 10 is folded to form the envelope 12 while the glue of the glue line 46 is still wet (active), so that its purpose is to glue the respective margin of the panel 16 to the surface 14 on the panel 18 near the gable panel 22. Preferably, the panel 16 is narrower than the panel 18 by an amount which causes it to barely non-overlap with the envelope gable 48 when the envelope is disposed in a flat condition. Thus, although the glue line 46 is shown provided on the panel 18, it could be provided in addition or instead where it contacts the panel 20 as the envelope is folded from the blank. (As those skilled in the art, the same can be said of others of the glue lines; so, equivalent placement is within the contemplation of the invention.)

The tab 38 is shown provided near its free end with the die-cut window 50, which, in the example, is straight, elongated transversally of the panel, measures 3.75×0.375 inches, has filleted corners, is located 0.25 inch from the free end of the tab 38 and terminates 0.25 inch from each lateral edge of the tab 38. The thickness of this tab 38 and this window 50 will, on the envelope 12, provide a frame for an exposed, yet recessed, resealable adhesive area 52 for releasably sealing the envelope flap, so as to minimize inadvertent contact with the exposed resealable adhesive.

Centered (in a left-to-right sense) on the tab 38 below the window 50 there is shown a die-cut slit 54 that will serve as the mouth for an adjunct pocket 56 of the envelope 12. In the presently preferred embodiment, the slit 54 is 3.0 inches wide, downwardly concave (frowning) with its ends disposed on the baseline 58 of the panel 38 (and, therefore, of the flap 44). Preferably, the contour of the slit 54 is prolate semioval, with central arch height of 0.50 inch above the baseline 58.

The pocket-dividing panel 16 integrally adjoins the front main panel 18 along a longitudinal fold line 60. The front main panel 18 integrally adjoins the narrow gable panel 22 along a longitudinal fold line 62. The narrow gable panel 22 integrally adjoins the narrow gable panel 24 along a longitudinal fold line 64. The narrow gable panel 24 integrally adjoins the rear main panel 20 along a longitudinal fold line 66. And, the rear main panel 20 integrally adjoins the lap joint flap 26 along a longitudinal fold line 68.

By preference, the bottom of the envelope 12 is provided by serially gluing together face to face the panels 16, 18 and 20 along transversally extensive regions near the lower end 30 of the blank. Although the gluing could be accomplished along all of the bottom edge 30, all that is really necessary is that any gaps left be so small that nothing, which can be reasonably expected to be shipped in the envelope, could fall out through any gap that is left. Accordingly, by preference, this gluing is provided in two transversally extending, transversally aligned lines 70, 72, respectively applied on the panels 18 and 20. Both are shown terminating just short of where the gable panels 22, 24 confront the respective panels 18, 20 on the flattened bag 12, and extending to just short of the respective longitudinal fold lines 60 and 68. In the example shown, the glue lines 70, 72 are spaced 0.125 inch from the edge 30 and fold lines 60 and 68 are 4.625 inches wide (widthwise of the blank and envelope), and 1.625 inches tall (longitudinally of the blank and envelope). By making the glue lines 70, 72 so extensive, as the surface 14 of the lower marginal region of the panel 16 is glued to the surface 14 of the lower marginal region of the panel 18 by the glue line 70, and the opposite surface 74 of the lower marginal region of the panel 16 is glued to the surface 14 of the lower marginal region of the panel 20 by the glue line 72, a monolithic three-layer lower marginal lamination 76 is provided.

(By preference, as the envelope 12 is being manufactured, various text and graphical indicia are printed on it, largely corresponding in function, if not precisely in placement, to those which are described above (in the "Background" section) as being provided in the film-processing envelope packet of the prior art. By preference, the machine readable (e.g., U.P.C. bar-coded) unique number that is provided on the body of the envelope is so printed that it becomes located on the outside surface 74, on the lamination 76. Due to the stiffness caused by lamination of the three layers together by the glue areas 70, 72, this lower margin of the envelope is easy to slide through a slot-type bar-code reader, and will remain flat for reading by a hand-held scanner or by a supermarket check-out-type flat-bed bar code reader.)

The narrow lap joint panel 26 is shown provided on the surface 14 with a longitudinal glue line 78 marginally of the edge 34, practically from end to end on the lap joint panel 26.

As the blank 10 is folded to form the envelope 12, the panel 26 is lapped onto the outside face 74, and the glue 78 (which, at that time, is still wet (active)) forms a joint bordering the fold line 68.

The tab 40 is shown provided on the surface 14 with a transversally extending band 80 of resealable adhesive. By strong preference, this adhesive is not a glue that one must wet for it to become temporarily active (as when one licks the glue on the flap of an ordinary business envelope), nor is it a latex-based short-term active resealable adhesive such as has been described above (in the "Background" section) as being conventionally used in the pre-existing prior art product, but preferably is the so-called low-tack or re-repositionable adhesive which is conventionally used on the well-known Post-it TM Notes of 3M Commercial Office Supply Division, Saint Paul, Minn. 55144-1000.

The resealable adhesive band 80 is positioned so as to provide the resealable adhesive area 52 as the blank is folded to form the envelope. As illustrated, the adhesive band 80 may be larger than the window 50, so that part of it extends outside the perimeter of the window 50 to laminate the tabs 38 and 40 together, above the slit 54. Alternatively, the window-surrounding, tab-laminating portion of the adhesive may be a permanent glue, such as is used for providing the glue lines 70, 72, 46 and 78.

In the course of using the envelope 12, the flap 44 will be folded over along its baseline 58. In order to facilitate that folding, the baseline can be given a coinciding fold-facilitation line of compression, such as is commonly provided for envelope flaps.

At the same level as the baseline 58, the base of the claim check 82, while existing as an integral flap 42 on the upper end of the rear main panel is caused to be easily severable by tearing off along a transverse line of weakness (e.g., a perforation line) 83.

The unique number which preferably is imprinted in machine-readable form at 84 on the outside face 74 of the front main panel 18 of the envelope on the three-layer laminated lower border region 76, also preferably is provided elsewhere on the envelope body, e.g., on the front at 86 near the top end of the front main panel. And it is surely provided on the claim check, e.g., as at 88.

Although, by preference, only one of the side edges of the envelope (e.g., the left side as seen from the front) is provided with a gable, the other side could be provided with a similar gable, by elaboration of the lap joint shown. However, it is generally not needed, and the lap joint is more readily provided.

Figure 7:
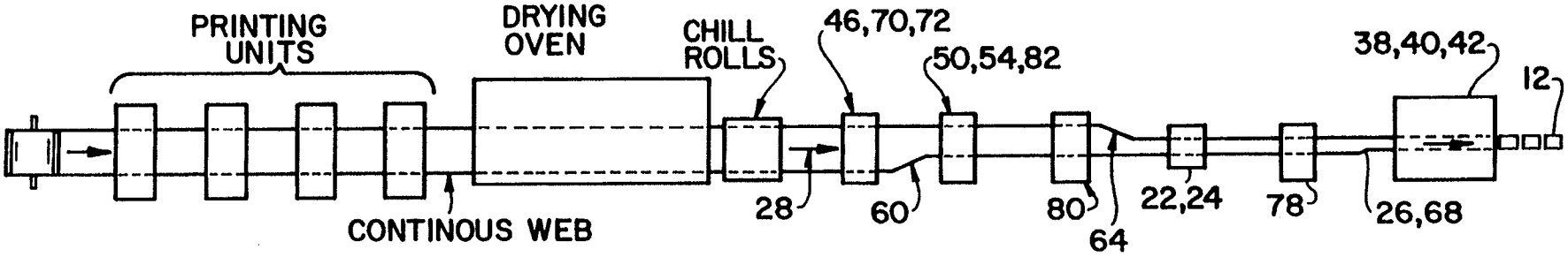
FIG. 7 is a schematic view of a processing line for manufacturing a stream of envelopes of the present invention, in line, from a continuous web of flexible sheet material.

In the flow diagram which is shown in FIG. 7, the various items of standard equipment are given word labels indicating generically what they are, and by lead lines with arrows and repetition of the numbers used in FIGS. 1–6, the sites where several of the envelope features are preferably created are generally indicated.

In normal intended use, the consumer selects an envelope 12, fills in the information requested in the various blanks printed on the outside of the front and/or rear main panels, inserts photographic material into the main pocket (compartment) 90 through the open main mouth 92, tears off the claim check 82, and folds over the two-layer flap 44 along the baseline 58, thereby releasably closing the envelope 12. (Without needing to give thought to it, the user has, at this stage, also folded over the adjunct one-layer flap 94 delineated by the slit 54 and baseline 58.)

At the processor's facility, the envelope is opened by pulling up on the flap 44, causing the resealable adhesive 80, within the area 52 to let go of the outside surface of the rear main panel of the envelope body. The processor then removes and works on the incoming photographic material (such as film to be developed, negatives to be printed, prints to be duplicated, or the like). The processor thus produces two types of outgoing photographic materials (e.g., the developed negatives and the prints made therefrom). In such case, the processor slides the prints into the main pocket 90 of the envelope 12 through the open main mouth 92, and slides the negatives into the adjunct pocket 56 through the open adjunct mouth at adjunct flap 94, then folds down and reseals the main flap using the resealable adhesive 80, thereby reclosing the envelope 12.

At the drop-off/pick-up location, the customer receives the envelope and pays for the processing, and reopens the envelope by lifting the flap 44, thereby gaining access to the photographic materials contained in the main and adjunct pockets 90, 56 of the envelope 12.

It should now be apparent that the film-processing envelope as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An envelope, comprising:

a parametrically complete, flattened, convolute strip of flexible sheet material having two axially opposite ends, said strip being sufficiently overlapped parametrically thereof as to comprise three layers throughout most of the width thereof, including a front main panel, a rear main panel, and a compartment-dividing intermediate panel sandwiched between said front and rear main panels and dividing internal space within said envelope into a main compartment and an adjunct compartment;

said front and rear main panels being integrally connected along respective adjoining longitudinal margins thereof and having respective opposite longitudinal margins;

one of said main panels and said intermediate panel being integrally connected along one longitudinal margin of said intermediate panel and a respective said opposite longitudinal margin of said one main panel; said intermediate panel having an opposite longitudinal margin;

an integral tabular longitudinal extension from one of said main panels at one end of said strip being foldable over said end into overlapping relation with a respective portion of the other of said main panels to thereby provide at least part of a closure flap for closing said one end of said strip, and therefore, respective one ends of said compartments of said envelope;

cooperative means on said closure flap and said other main panel for maintaining said closure flap in closing relation to said one end;

means closing the other end of said strip and therefore respective other ends said compartments of said envelope, this means comprising a first transversally extending glue line securing a marginal region of said front main panel, at a site which is adjacent said other end of said strip to a confronting marginal region of said intermediate panel near said other end of said strip and a second transversally extending glue line securing a marginal region of said rear main panel, at a site which is adjacent said other end of said strip, to a confronting marginal region of said intermediate panel near said other end of said strip, and thereby providing a three-layer lamination of said sheet material extending widthwise of said envelope adjacent said other end.

2. The envelope of claim 1, further comprising:

a claim check integrally and severably connected with said strip of sheet material along a line of weakness;

a unique series of identifying symbols imprinted on said claim check and repeated in machine-readable form on said envelope in superimposed relation to said three-layer lamination.

3. The envelope of claim 2, wherein:

said claim check is contiguous with said other main panel at said one end of said strip along said line of weakness.

4. The envelope of claim 2, wherein:

said intermediate panel is contiguous with said front main panel along a first longitudinal fold line; second, third and fourth longitudinal fold lines defining a gable intervening between said adjoining longitudinal margins of said front and rear main panels; and first longitudinal glue joint means joining said rear main panel along said opposite longitudinal margin thereof with said one longitudinal margin of said intermediate panel.

5. The envelope of claim 4, further including:

a second longitudinal glue joint means joining said opposite longitudinal margin of said intermediate panel to one of said main panels adjacent said gable.

6. The envelope of claim 4, wherein:

said first longitudinal glue joint means comprises a longitudinal glue line provided on a lap joint panel which is contiguous with said opposite longitudinal margin of said rear main panel.

7. The envelope of claim 2, wherein:

said closure flap further includes a second integral tabular longitudinal extension from said intermediate panel at said one end of said strip; means defining a transversally extending opening through said second tabular extension and therefore into said adjunct compartment; means defining a die-cut window through said second tabular extension in registry with a layer of repositionable adhesive on the first-described said tabular extension and thus providing one of said cooperative means for maintaining said closure flap in closing relation to said one end; and means laminating said tabular extensions to one another in a region which is disposed longitudinally beyond said transversally extending opening.

8. The envelope of claim 1, wherein:

said closure flap further includes a second integral tabular longitudinal extension from said intermediate panel at said one end of said strip; means defining a transversally extending opening through said second tabular extension and therefore into said adjunct compartment; means defining a die-cut window through said second tabular extension in registry with a layer of repositionable adhesive on the first-described said tabular extension and thus providing one of said cooperative means for maintaining said closure flap in closing relation to said one end; and means laminating said tabular extensions to one another in a region which is disposed longitudinally beyond said transversally extending opening.

9. An envelope, comprising:

a parametrically complete, flattened, convolute strip of flexible sheet material having two axially opposite ends, said strip being sufficiently overlapped parametrically thereof as to comprise three layers throughout most of the width thereof, including a front main panel, a rear main panel, and a compartment-dividing intermediate panel sandwiched between said front and rear main panels and dividing internal space within said envelope into a main compartment and an adjunct compartment;

an integral tabular longitudinal extension from one of said main panels at one end of said strip being foldable over said end into overlapping relation with a respective portion of the other of said main panels as at least part of a closure flap for closing said one end of said strip, and therefore, of said compartments of said envelope;

cooperative means on said closure flap and said other main panel for maintaining said closure flap in closing relation to said one end;

means closing the other end of said strip and therefore said compartments of said envelope;

said closure flap further includes a second integral tabular longitudinal extension from said intermediate panel at said one end of said strip; means defining a transversally extending opening through said second tabular extension and therefore into said adjunct compartment; means defining a die-cut window through said second tabular extension in registry with a layer of repositionable adhesive on the first-described said tabular extension and thus providing one of said cooperative means for maintaining said closure flap in closing relation to said one end; and means laminating said tabular extensions to one another in a region which is disposed longitudinally beyond said transversally extending opening.

10. The envelope of claim 9, further comprising:

a claim check integrally but severably connected with said strip of sheet material along a line of weakness.

11. The envelope of claim 10, wherein:

said claim check is contiguous with said other main panel at said one end of said strip along said line of weakness.

12. The envelope of claim 9, wherein:

said intermediate main panel is contiguous with said front main panel along a first longitudinal fold line; second, third and fourth longitudinal fold lines defining a gable intervening between adjoining longitudinal margins of said front and rear main panels; and first longitudinal glue joint means joining said rear main panel along an opposite longitudinal margin thereof with a same longitudinal margin of said intermediate panel as that which is contiguous with said front main panel.

13. The envelope of claim 12, further including:

a second longitudinal glue joint means joining an opposite longitudinal margin of said intermediate panel to one of said main panels adjacent said gable.

14. The envelope of claim 12, wherein:

said first longitudinal glue joint means comprises a longitudinal glue line provided on a lap joint panel which is contiguous with said opposite longitudinal margin of said rear main panel.

* * * * *